US007557313B2

(12) United States Patent
Chao

(10) Patent No.: US 7,557,313 B2
(45) Date of Patent: Jul. 7, 2009

(54) KEYSWITCH AND KEYOARD

(75) Inventor: Ling Hsi Chao, Taoyuan (TW)

(73) Assignee: Darfon Electronics Corp., Taoyuan (TW)

( * ) Notice: Subject to any disclaimer, the term of this patent is extended or adjusted under 35 U.S.C. 154(b) by 71 days.

(21) Appl. No.: 11/970,837

(22) Filed: Jan. 8, 2008

(65) Prior Publication Data

US 2008/0164131 A1 Jul. 10, 2008

(30) Foreign Application Priority Data

Jan. 10, 2007 (TW) ..... 96200456 U

(51) Int. Cl.
*H01H 3/12* (2006.01)

(52) U.S. Cl. ..... 200/5 A; 200/341

(58) Field of Classification Search ..... 200/5 A, 200/341–345, 512–520; 341/22; 345/168, 345/169; 400/490, 491.2
See application file for complete search history.

(56) References Cited

U.S. PATENT DOCUMENTS

| | | | | |
|---|---|---|---|---|
| 7,183,512 | B2 * | 2/2007 | Lee et al. | 200/344 |
| 7,199,320 | B2 * | 4/2007 | Sato | 200/341 |
| 7,288,733 | B2 * | 10/2007 | Yamada et al. | 200/5 A |
| 7,332,687 | B2 * | 2/2008 | Liu | 200/344 |
| 7,345,253 | B2 * | 3/2008 | Hsu | 200/344 |
| 7,385,149 | B2 * | 6/2008 | Liu | 200/5 A |
| 7,402,765 | B2 * | 7/2008 | Yu | 200/5 A |
| 7,417,200 | B2 * | 8/2008 | Hsu | 200/5 A |

* cited by examiner

*Primary Examiner*—Michael A Friedhofer
*Assistant Examiner*—Lisa N Klaus
(74) *Attorney, Agent, or Firm*—Morris, Manning & Martin LLP; Tim Tingkang Xia

(57) ABSTRACT

The invention discloses a keyswitch for preventing itself from being damaged by the entrance of water and for increasing its lifetime. The keyswitch includes a substrate, a switch, a supporting device, a deformable shielding and a keycap. The switch is mounted on the substrate. The supporting device has an upper engagement portion and a lower engagement portion engaged to the substrate. The deformable shielding has a top portion, and a plurality of apertures is formed on the top portion of the deformable shielding. The keycap thereof defines a lower surface and has a plurality of retaining lugs formed on the lower surface. In particular, the deformable shielding is capable of deforming during the movement of the keycap and further covering the substrate, the switch, and the supporting device.

11 Claims, 3 Drawing Sheets

KEYSWITCH AND KEYOARD

BACKGROUND OF THE INVENTION

1. Field of the Invention

The invention relates to a keyswitch for preventing itself from being damaged by the entrance of water and for increasing its lifetime. In particular, the invention relates to a keyswitch equipped with a deformable shielding which is capable of deforming during the movement of the keycap and further covering the substrate, the switch, and the supporting device, so as to achieve the purposes of dust proofing and spill proofing.

2. Description of the Prior Art

With the evolvement of information, information equipment is getting more and more popular. For instance, there are various kinds of brands and types of conventional computers in the market. The computers are used in home, factories, companies, offices and school and available for all people. They almost become humans' daily necessities. Accordingly, how to maintain the validity of operating computers and how to prevent this kind of high technology products from being damaged are important issues for everyone.

However, keyboard, one kind of peripheral device, is the most likely to be contaminated. Any dust floating in the air, or tobacco ash, beverage, or drips which are carelessly dropped by users are all able to cause damages to keyboards and affect the lifetime of computers.

In order to solve the problems of dust proofing and spill proofing, improvements of different kinds of keyswitch were disclosed. For instance, a conventional waterproof keyboard was disclosed in Taiwan patent number 236428. A plurality of drainpipes and holes are disposed at the lower surface of the upper cover and on the lower cover respectively. Fluid can be guided to a water tank disposed under the lower cover by the drainpipes, so as to prevent the fluid from flowing to circuit units. However, the design is much complex, and it is difficult to produce the keyboard on which the drainpipes and holes are disposed. Moreover, if the keyboard is incautiously upset, the fluid stored in the water tank will flow back in the keyboard to cause serious damages.

Accordingly, in order to prevent the aforesaid situations, the scope of the invention is to provide a dustproof and spill proof keyswitch which utilizes a deformable shielding to isolate contaminations under the keycap, so as to decrease the damage rate and increase the lifetime of keyswitches.

SUMMARY OF THE INVENTION

A scope of the invention is to provide a keyswitch for decreasing the damage rate and increasing its lifetime. In particular, the deformable shielding of the keyswitch is capable of deforming during the movement of the keycap and further covering the substrate, the switch, and the supporting device. Users can effectively diminish the possibility of breakage of keyswitches caused by environmental factors.

According to a preferred embodiment, a keyswitch of the invention includes a substrate, a switch, a supporting device, a deformable shielding and a keycap. The switch is mounted on the substrate. The supporting device has an upper engagement portion and a lower engagement portion engaged to the substrate. The deformable shielding has a top portion, and the deformable shielding is disposed on the substrate and covers the switch and the supporting device. And, a plurality of apertures are formed on the top portion. The keycap thereof defines a lower surface and has a plurality of retaining lugs formed on the lower surface. Alternatively, the retaining lugs passes through the apertures of the top portion to engage with the upper engagement portion of the supporting device, or the upper engagement portion of the supporting device passes through the apertures of the top portion to engage with the retaining lugs. Besides, according to the keyswitch of the invention, the supporting device supports the keycap to vertically move relative to the substrate, and the switch is selectively switched on in response to the movement of the keycap.

Accordingly, the keyswitch of the invention can achieve the functions of dust proofing and spill proofing with the deformable shielding between the keycap and the supporting device.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
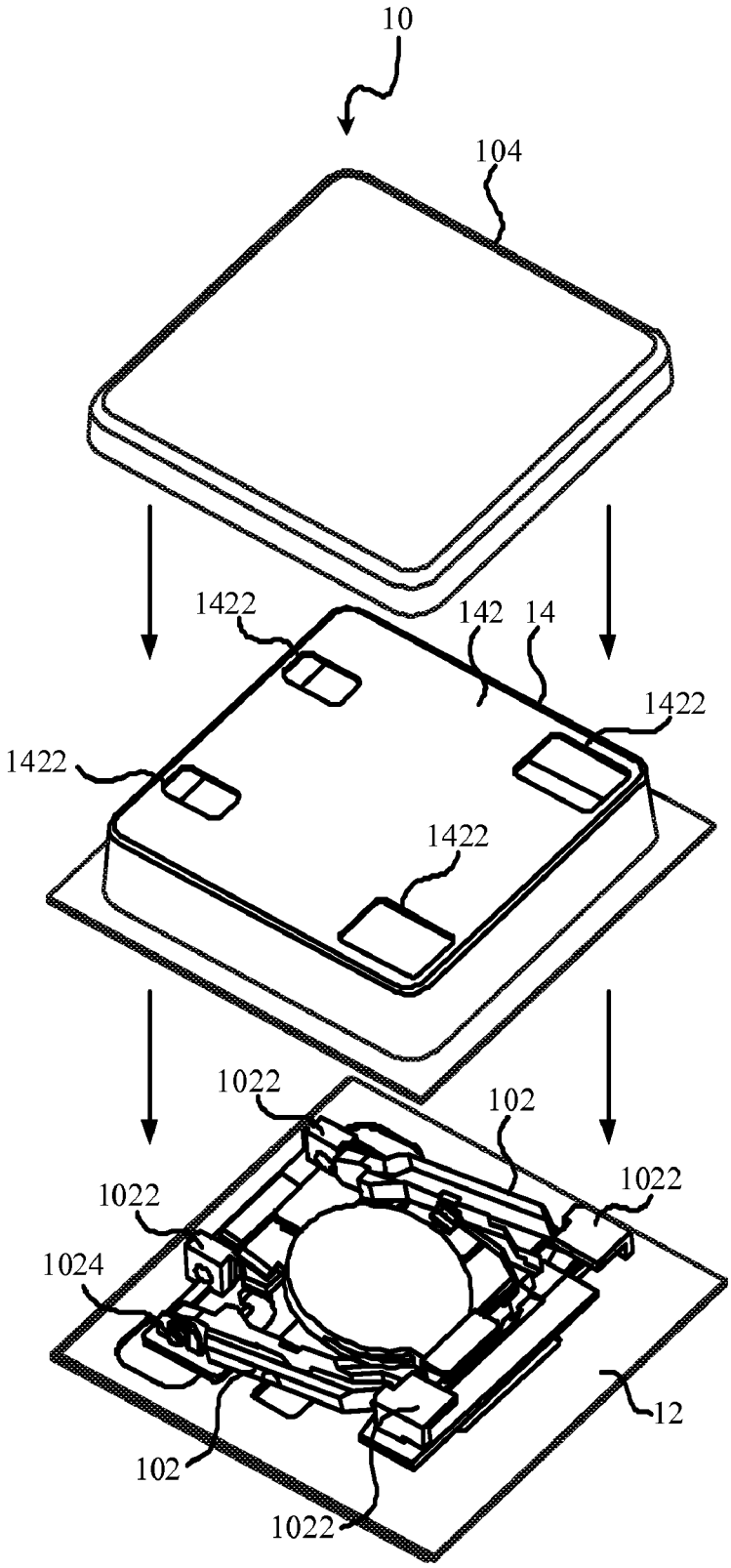
FIG. 1 is an exploded view illustrating a keyswitch according to a preferred embodiment of the invention.

Please refer to FIG. 1. FIG. 1 is an exploded view illustrating a keyswitch 10 according to a preferred embodiment of the invention. As shown in FIG. 1, the keyswitch 10 includes a substrate 12, a switch (not shown in FIG. 1), a supporting device 102, a deformable shielding 14 and a keycap 104.

As shown in FIG. 1, the switch is mounted on the substrate 12. The supporting device 102 has an upper engagement portion 1022 and a lower engagement portion 1024 engaged to the substrate 12. The deformable shielding 14 has a top portion 142, and the deformable shielding 14 is disposed on the substrate 12 and covers the switch and the supporting device 102. A plurality of apertures 1422 are formed on the top portion 142. The deformable shielding 14 can be formed of a rubber material or a polymer material.

Figure 2:
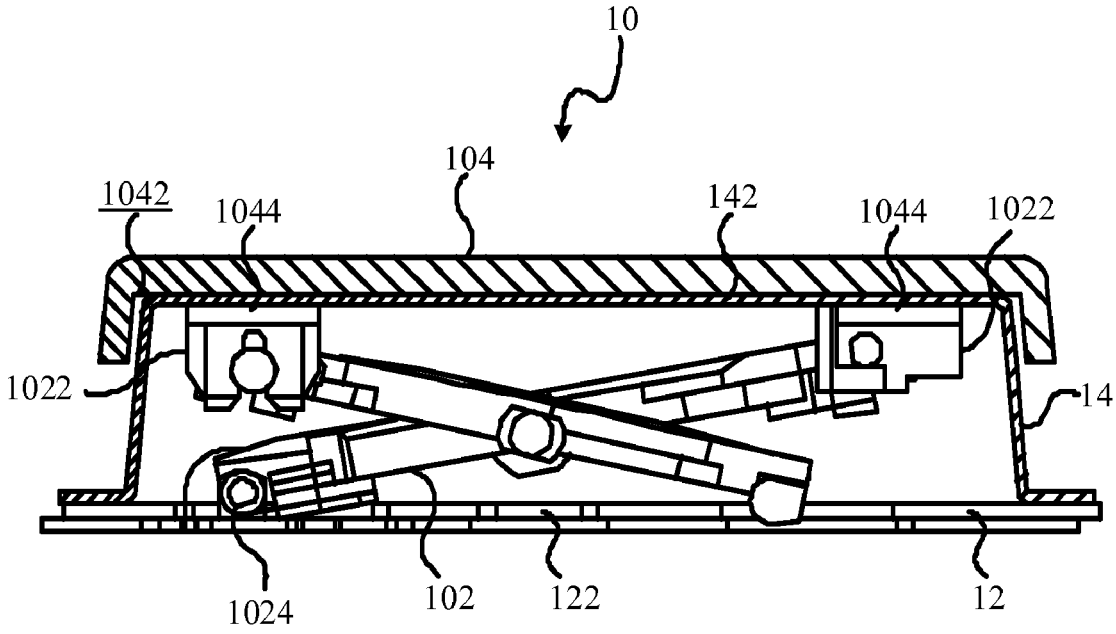
FIG. 2 is a cross-sectional view of the keyswitch in FIG. 1.

Please refer to FIG. 2. FIG. 2 is a cross-sectional view of the keyswitch 10 in FIG. 1. As shown in FIG. 2, the keycap 104 thereof defines a lower surface 1042 and has a plurality of retaining lugs 1044 formed on the lower surface 1042.

In an embodiment, the retaining lugs 1044 pass through the apertures 1422 of the top portion 142 to engage with the upper engagement portion 1022 of the supporting device 102. In another embodiment, the upper engagement portion 1022 of the supporting device 102 passes through the apertures 1422 of the top portion 142 to engage with the retaining lugs 1044. In the embodiment, the retaining lugs 1044 pass through the apertures 1422 of the top portion 142 to engage with the upper engagement portion 1022 of the supporting device 102.

Also shown in FIG. 2, according to the keyswitch 10 of the invention, the supporting device 102 supports the keycap 104 to vertically move relative to the substrate 12, and the switch 122 is selectively switched on in response to the movement of the keycap 104. In the embodiment, the lower surface 1042 of the keycap 104 is adapted to engage with the top portion 142 of the deformable shielding 14, and the supporting device 102 a scissors-type supporting device. Moreover, when the keycap 104 moves downward under an external force, the deformable shielding 14 supports the keycap 104 and deforms responsive to the reciprocal movement of the keycap 104. Thus, the keycap 104 which is pressed downward can return to its highest position without an elastic dome such as a rubber dome.

Figure 3:
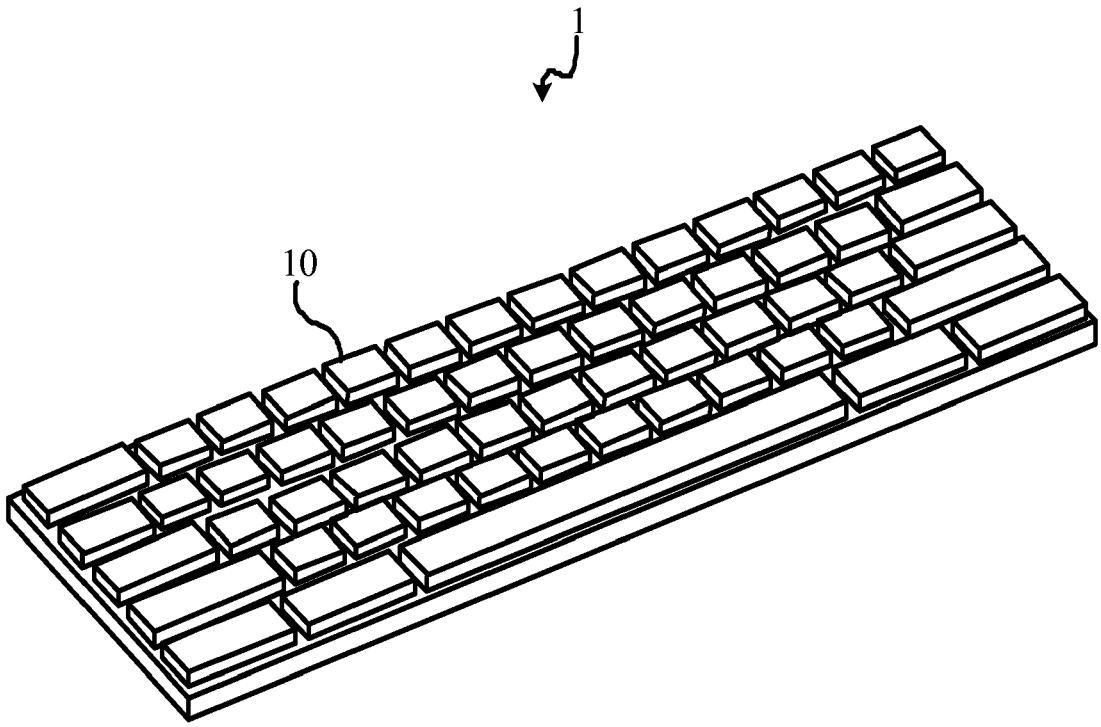
FIG. 3 is a schematic diagram illustrating the appearance of a keyboard according to another preferred embodiment of the invention.

Please refer to FIG. 3. FIG. 3 is a schematic diagram illustrating the appearance of a keyboard 1 according to another preferred embodiment of the invention. As shown in FIG. 3, the keyboard 1 includes a plurality of keyswitches 10. The structure of the keyswitch 10 can be referred to FIG.1. The keyboard 1 includes a substrate 12, a plurality of switches 122, a plurality of supporting devices 102, a deformable shielding 14, and a plurality of keycaps 104.

Moreover, the switches 122 are mounted on the substrate 12. Each of the supporting devices 102 has an upper engagement portion 1022 and a lower engagement portion 1024 engaged to the substrate 12. The deformable shielding 14 has a plurality of top portions 142 which correspond to the switches 122 and the supporting devices 102. The deformable shielding 14 is disposed on the substrate 12 and covers the switches 122 and the supporting devices 102. Besides, each top portion 142 thereon is formed a plurality of apertures 1422. The deformable shielding 14 is formed of a rubber material or a polymer material. Each keycap 104 corresponds to one top portion 142, defines a lower surface 1042, and has a plurality of retaining lugs 1044 formed on the lower surface 1042 thereof. Alternatively, the retaining lugs 1044 pass through the apertures 1422 of the top portions 142 to engage with the upper engagement portions 1022 of the supporting devices 102, or the upper engagement portions 1022 pass through the apertures 1422 of the top portions 142 to engage with the retaining lugs 1044 of the keycaps 104. Similarly, in the embodiment, the retaining lugs 1044 pass through the apertures 1422 of the top portions 142 to engage with the upper engagement portions 1022 of the supporting devices 102.

Herein, each supporting device 102 supports the corresponding keycap 104 to vertically move relative to the substrate 12, and each switch 122 is selectively switched on in response to the movement of the corresponding keycap 104. Moreover, when one of the plurality of keycaps 104 moves downward under an external force, the deformable shielding 14 supports the keycap 104 and deforms responsive to the reciprocal movement of the keycap 104. Thus, the keycap 104 which is pressed downward can return to its highest position without an elastic dome such as a rubber dome.

Similarly, in the embodiment, each top portion 142 is adapted to cover one corresponding switch 122 and one corresponding supporting device 102, and the lower surface 1042 of each keycap 104 is adapted to engage with the corresponding top portion 142. Each supporting device 102 is a scissors-type supporting device.

In the light of the foregoing deformable shielding of the preferred embodiment, in a practical application, it is preferable that border between deformable shieldings under the corresponding keycaps is formed seamlessly in order to make the whole keyboard achieve functions of dust proofing and spill proofing. Hence, for the whole keyboard, the deformable shieldings under keycaps of all keyswitches can be formed integrally to be one piece deformable shielding adapted to the whole keyboard.

Compared to prior arts, the keyswitch and the keyboard of the invention can achieve the functions of dust proofing and spill proofing with the deformable shielding disposed between the keycap and the supporting device, and prevent fluid from flowing into the keyboard directly.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A keyswitch, comprising:

a substrate;

a switch, mounted on the substrate;

a supporting device having an upper engagement portion and a lower engagement portion engaged to the substrate;

a deformable shielding, having a top portion, being disposed on the substrate and covering the switch and the supporting device, wherein a plurality of apertures are formed on the top portion; and a keycap thereof defining a lower surface and having a plurality of retaining lugs formed on the lower surface, alternatively, the retaining lugs passing through the apertures of the top portion to engage with the upper engagement portion of the supporting device, or the upper engagement portion of the supporting device passing through the apertures of the top portion to engage with the retaining lugs;

wherein the supporting device supports the keycap to vertically move relative to the substrate, and the switch is selectively switched on in response to the movement of the keycap.

2. The keyswitch of claim 1, wherein the lower surface of the keycap is adapted to engage with the top portion of the deformable shielding.

3. The keyswitch of claim 1, wherein the supporting device is a scissors-type supporting device.

4. The keyswitch of claim 1, wherein the deformable shielding is formed of a rubber material or a polymer material.

5. The keyswitch of claim 1, wherein when the keycap moves downward under an external force, the deformable shielding supports the keycap and deforms responsive to the reciprocal movement of the keycap.

6. A keyboard, comprising:

a substrate;

a plurality of switches, mounted on the substrate;

a plurality of supporting devices which each has an upper engagement portion and a lower engagement portion engaged to the substrate;

a deformable shielding having a plurality of top portions which correspond to the switches and the supporting devices, the deformable shielding being disposed on the substrate and covering the switches and the supporting devices, wherein each top portion thereon is formed a plurality of aperture; and a plurality of keycaps which each corresponds to one top portion, defines a lower surface and has a plurality of retaining lugs formed on the lower surface thereof, alternatively, the retaining lugs of each keycap passing through the apertures of the corresponding top portion to engage with the upper engagement portion of the corresponding supporting device, or the upper engagement portion of each supporting device passing through the apertures of the corresponding top portion to engage with the retaining lugs of the corresponding keycap;

wherein each supporting device supports the corresponding keycap to vertically move relative to the substrate, and each switch is selectively switched on in response to the movement of the corresponding keycap.

7. The keyboard of claim 6, wherein each top portion is adapted to cover one corresponding switch and one corresponding supporting device.

8. The keyboard of claim 7, wherein when one of the plurality of keycaps moves downward under an external force, the deformable shielding supports the keycap and deforms responsive to the reciprocal movement of the keycap.

9. The keyboard of claim 6, wherein the lower surface of each keycap is adapted to engage with the corresponding top portion.

10. The keyboard of claim 6, wherein each supporting device is a scissors-type supporting device.

11. The keyboard of claim 6, wherein the deformable shielding is formed of a rubber material or a polymer material.

* * * * *